US006763615B2

(12) United States Patent
Mitsui et al.

(10) Patent No.: US 6,763,615 B2
(45) Date of Patent: Jul. 20, 2004

(54) SHOE WITH ARCH REINFORCEMENT

(75) Inventors: Shigeyuki Mitsui, Kobe (JP); Tsuyoshi Nishiwaki, Kobe (JP); Noboru Nakabe, Kobe (JP); Masashi Isobe, Kobe (JP)

(73) Assignee: Asics Corporation, Kobe (JP)

( * ) Notice: Subject to any disclaimer, the term of this patent is extended or adjusted under 35 U.S.C. 154(b) by 0 days.

(21) Appl. No.: 10/655,458

(22) Filed: Sep. 4, 2003

(65) Prior Publication Data

US 2004/0079000 A1 Apr. 29, 2004

Related U.S. Application Data

(62) Division of application No. 10/235,254, filed on Sep. 5, 2002, now Pat. No. 6,647,646, which is a continuation of application No. 09/574,051, filed on May 18, 2000, now Pat. No. 6,467,197.

(30) Foreign Application Priority Data

May 31, 1999 (JP) ..... 11-151281
May 31, 1999 (JP) ..... 11-151282

(51) Int. Cl.[7] ..... A43B 7/22
(52) U.S. Cl. ..... 36/91; 36/28; 36/31; 36/30 R
(58) Field of Search ..... 36/91, 28, 31, 36/30 R

(56) References Cited

U.S. PATENT DOCUMENTS 4,316,334 A 2/1982 Hunt
4,372,058 A 2/1983 Stubblefield
4,399,620 A 8/1983 Funck
4,506,462 A * 3/1985 Cavanagh
4,542,598 A * 9/1985 Misevich et al.
4,546,559 A 10/1985 Dassler
4,547,979 A 10/1985 Harada
4,730,402 A * 3/1988 Norton et al.
4,741,114 A 5/1988 Stubblefield
4,785,557 A 11/1988 Kelly
RE33,066 E * 9/1989 Stubblefield
4,878,300 A * 11/1989 Bogaty
5,046,267 A 9/1991 Kilgore
5,052,130 A * 10/1991 Barry et al.
5,079,856 A 1/1992 Truelsen
5,185,943 A * 2/1993 Tong et al.
5,280,680 A * 1/1994 Burke et al.
5,319,866 A 6/1994 Foley
5,325,611 A * 7/1994 Dyer et al.
5,367,792 A 11/1994 Richard
5,440,826 A 8/1995 Whatley
5,528,842 A * 6/1996 Ricci et al.
5,784,808 A 7/1998 Hockerson
5,787,610 A 8/1998 Brooks
5,797,199 A 8/1998 Miller
5,845,420 A 12/1998 Buccianti
5,860,226 A * 1/1999 Graham et al.
6,119,373 A * 9/2000 Gebhard et al.
6,199,302 B1 * 3/2001 Kayano
6,212,795 B1 * 4/2001 Nakabe et al.
6,467,197 B1 * 10/2002 Mitsui et al. ..... 36/91
6,647,646 B2 * 11/2003 Mitsui et al. ..... 36/91

* cited by examiner

*Primary Examiner*—Ted Kavanaugh
*Assistant Examiner*—E. Parton
(74) *Attorney, Agent, or Firm*—Michael E. Zall

(57) ABSTRACT

Disclosed is a shoe sole comprising an outer sole 1F, 1B, a midsole 2 and a reinforcement device 4 made of a resin plate. The reinforcement device 4 is firmly secured to the underside of an arch portion 2M of the midsole 2. At a medial side 11 and a lateral side 10 of the foot, the reinforcement device 4 is shaped like an arch between separated outer sole parts 1F and 1B. A medial foot portion 43 of the reinforcement device 4 is formed to have a higher hardness than a lateral foot portion 40 of the reinforcement device 4. This allows the reinforcement device 4 to have a greater flexural rigidity in its medial foot portion 43 than in its lateral foot portion 40.

8 Claims, 12 Drawing Sheets

SHOE WITH ARCH REINFORCEMENT

RELATED APPLICATIONS

This application is a divisional application of U.S. Ser. No. 10/235,254 filed on Sep. 5, 2002, now U.S. Pat. No. 6,647,646 which is a continuation of application of U.S. Ser. No. 09/574,051 filed on May 18, 2000, now U.S. Pat. No. 6,467,197, entitled Shoe With Arch Reinforcement. The entire disclosures of such applications are incorporated herein by reference.

BACKGROUND OF THE INVENTION

1. Field of the Invention

The present invention relates generally to shoes that are put on at the time of daily outing, jogging or exercises, and more particularly to a shoe sole.

2. Description of the Related Art

Nowadays, typical jogging shoes comprise a midsole.

The midsole is arranged on top of an outer sole to absorb shocks upon landing. To this end, the midsole is made of a material such as resin sponge (foam) that is excellent in shock absorbing properties and resilience. In order to attain such properties, the hardness of the resin sponge is usually set to a relatively low value.

Any sports shoes provided with a midsole having such a low hardness are apt to undergo a drastic deformation at their arch portions upon walking and running, causing the user to experience fatigue. Thus, some recently developed shoes include a reinforcement device(s) fastened fixedly to the underside of the mid foot portion of the midsole to prevent possible deformations.

FIG. 8 is a bottom plan view of a shoe sole disclosed in Japan Utility Model Registration Pub. No. 2, 544, 047.

In this prior art, reinforcement devices 310 and 311 are disposed at a lateral side 10 and a medial side 11, respectively, of a shoe sole 300 so as to prevent any planar flexural deformations along the shoe sole face as well as to restrain arches of the arch of the foot from being depressed.

However, the arches of the arch portion are high at the medial side but low at the lateral side. For this reason, if the flexural rigidity of the reinforcement devices 310 and 311 is increased, then the low arch at the lateral side may be subjected to a thrust-up force, with the result that user may have a sense of incongruity.

Likewise, if the flexural rigidity of the reinforcement devices 310 and 311 are reduced, then the high arch at the medial side may be depressed and the user may feel fatigue, and the pronation of the inclining foot toward the medial side may be excessive.

FIG. 9 is a perspective view of a shoe sole disclosed in Japan Patent Laid-open Pub. No. Hei9-47305.

In this prior art, cup-like stabilizers 320 and 321 are disposed on top of a midsole 322. The stabilizers 320 and 321 are separately arranged at the lateral side 10 and the medial side 11, respectively, and have different hardness values. However, this prior art employs no structure for supporting the arches of the arch, and hence it can not prevent the medial side arch from being depressed.

FIG. 10 is a top plan view of a shoe sole disclosed in Japan Patent Laid-open Pub. No. Hei5-329005.

In this prior art, the medial side 331 of the rear foot portion and the medial side 332 of the arch portion of the outer sole of the shoe sole are designed to have a higher hardness than the remaining portion 333 of the outer sole.

This prior art only addresses the hardness of the outer sole and does not contribute to preventing depression of the arches.

FIG. 11(*a*) is a top plan view of a midsole disclosed in Japan Patent Pub. No. Sho61-7801, and FIG. 11(*b*) is a side elevational view of the midsole disclosed in this publication.

This prior art discloses a pronation restricting member 202 disposed at the medial side 11 of the rear foot portion of the midsole 200, with the pronation restricting member 202 having a higher hardness than that of the midsole body 201. This prior art does not employ any structure to carry the arches of the arch and does not contribute preventing depression of the arches.

A midsole structure for enhancing the shock absorbing properties is disclosed in U.S. Pat. Nos. 4,372,058; 4,741,114; and 5,079,856 and Japan Patent Laid-open Pub. No. Hei5-115306. In these prior art references, the midsole rear foot portion is provided with a concavity that is recessed upward from the bottom face of the midsole. The cross sectional area of the midsole is thus reduced due to the formation of the concavity. By virtue of this, the midsole rear foot portion readily compressively deforms, the deformation absorbing shock which occurs upon landing.

However, easy deformation of the midsole may result in a lowered stability of the shoe sole. For this reason, pronating action tends to become larger after the landing, namely, the action of the foot inclining toward the medial side after the landing brings about overpronation.

SUMMARY OF THE INVENTION

It is therefore a major object of the present invention to provide a shoe sole capable of achieving a suppressed pronation.

Another object of the present invention is to provide a shoe sole capable of realizing a suppression of planar flexural deformation, a suppression of thrust-up toward the lateral side arch and a suppression of depression of the medial side arch.

A further object of the present invention is to provide a shoe sole capable of fully absorbing shocks upon the landing.

According to a first aspect of the present invention, in order to attain the above objects, the shoe sole comprises an outer sole, a midsole and a reinforcement device made of resin plate.

The outer sole has a tread face and is divided into a forefoot portion and a rear foot portion. The midsole is formed on top of the outer sole over the forefoot portion, an arch portion, and the rear foot portion. The reinforcement device is fixed firmly to the bottom face of the arch portion of the midsole.

The reinforcement device is formed in an arch form at a medial side and a lateral side of a foot between the divided portions of the outer sole. In this aspect, hardness in a medial side portion of a foot of the reinforcement device is established to be higher than that in a lateral side portion of a foot of the reinforcement device. As a result of this, flexural rigidity in the medial side portion of the foot of the reinforcement device is established to be higher than that in the lateral side portion of the foot of the reinforcement device.

As used herein, "reinforcement device made of resin plate" refers to a plate-like or chip-like resin molded into a predetermined arch-shape, or a knit, fabric or paper molded integrally with resin.

"Made of resin plate" means that the thickness of the reinforcement device is not so great, but it restricts by no means the geometry of the reinforcement device.

The reinforcement device is typically firmly secured to the underside of the arch portion of the midsole in an exposed manner, with the front and rear end portions of the reinforcement device being sandwiched between the midsole and the outer sole. However, the reinforcement device, except for the front and rear end portions, may partially or wholly be buried in the midsole as long as it is fixedly secured to the midsole in the vicinity of the underside of the midsole. The reinforcement device is thus firmly secured to the bottom surface side of the midsole, not to the top surface side.

In the present invention, "hardness of the reinforcement device made of resin plate is high" means that Young's modulus (modulus of longitudinal elasticity) of resin making up the reinforcement device is high. The reason this aspect is defined by the hardness is as follows. A higher Young's modulus of a member leads generally to a higher flexural rigidity of the member. In the case of shoes available on the market, it is easier to measure the hardness of an element than to measure the Young's modulus of members making up the reinforcement device. This is the reason that this aspect employs such a way of definition.

The hardness of the reinforcement device made of resin plate of the present invention can be measured by use of, e.g., a JIS D-type hardness meter (hardness meter having a triangular pyramid-shaped penetrator).

A second aspect of the shoe sole of the present invention comprises an outer sole, a midsole and a reinforcement device made of resin plate. The outer sole has a tread face and is divided into a forefoot portion and a rear foot portion. The midsole is formed on top of the outer sole over the forefoot portion, an arch portion, and the rear foot portion. The reinforcement device is fixed firmly to the bottom face of the arch portion of the midsole.

The reinforcement device is formed in an arch form at a medial side and a lateral side of a foot between the divided portions of the outer sole. In this aspect, thickness in a medial side portion of a foot of the reinforcement device is established to be greater than that in a lateral side portion of a foot of the reinforcement device. As a consequence thereof, flexural rigidity in the medial side portion of the foot of the reinforcement device is established to be higher than that in the lateral side portion of the foot of the reinforcement device.

According to the present invention, due to the provision of the reinforcement device on both the foot medial side and lateral side, it is possible to fully suppress the planar flexure irrespective of the division of the outer sole into front and rear parts.

In particular, the present invention allows the flexural rigidity in the foot medial side portion of the reinforcement device to be higher than that in the foot lateral portion of the reinforcement device, whereby the user is less likely to have a thrust-up feeling in the lateral side arch of the arch and it is possible to restrain the foot medial side arch of the arch from being depressed to thereby relieve the fatigue which the foot may experience.

In addition, the medial side arch of the arch has less of a tendency to be depressed in this manner so that the foot is restrained from being inclined toward the medial side, thereby enabling pronation to be suppressed.

It will be appreciated that by establishing the flexural rigidity of the reinforcement device by the resin hardness, the thickness of the reinforcement device can be set to an appropriate small value so that the lightweight properties of the shoe sole are not impaired.

In a preferred embodiment of the present invention, the reinforcement device is divided into two parts, one in a medial direction and the other in a lateral direction of a foot. Such a division into two parts permits the reinforcement device to be notched at the central site of the arch, thereby reducing the weight of the reinforcement device.

In the present invention, preferably the reinforcement device has a diagonal reinforcement portion arranged almost in the center between the medial and lateral sides of the foot. The diagonal reinforcement portion has an inclination extending in a diagonally outward direction from the rear end of the forefoot portion of the outer sole to the front end of the rear foot portion of the outer sole.

The foot is subjected to a pronation when the heel lateral side is inclined toward the toe medial side. As measures against this, the diagonal reinforcement device serves to enhance the flexural rigidity so as to restrain the foot from being inclined. A further suppression of pronation is thus achieved.

In another preferred embodiment of the present invention, if the midsole is made of foam resin, then the medial side of the arch portion of the midsole is established to have a higher hardness value than that of the lateral side of the rear foot portion of the midsole and the forefoot portion of the midsole.

By establishing the hardness of the midsole in this manner, the medial side of the arch portion of the midsole is subjected to a reduced compressive deformation and to a reduced compression set. The coaction with the reinforcement device provides a support to the medial side of the midsole causing a further suppression of the depression of the medial side arch of the arch. Moreover, the support of the midsole by the hard reinforcement device can suppress the depression of the arch without increasing the midsole hardness to a large extent so that the user does not have a sense of incongruity at the medial side arch of the arch.

According to a third aspect of the present invention, the shoe sole comprises an outer sole and a midsole.

The outer sole has a tread face in a forefoot portion and a rear foot portion. The midsole is formed extending from a forefoot portion to a rear foot portion on top of the outer sole.

The rear foot portion of the midsole is formed extending from a medial side to a lateral side of a foot. An exposed portion, that is not covered with the outer sole, is arranged almost in the center between the medial and lateral sides of the foot in the rear foot portion of the midsole.

The exposed portion has a hollow concavity formed upwardly from the tread face (bottom face). The concavity has a rootbottom portion of which depth is the largest in cross section of the midsole.

The rootbottom portion of the concavity is elongated along substantially the longitudinal direction of the shoe sole. The rootbottom portion of the concavity is arranged at a site closer to the lateral side of the foot. The concavity becomes gradually deeper as it is closer from the medial side of the foot to the rootbottom portion. As a result of imparting such a geometry to the concavity, in the rear foot portion of the midsole, the lateral side is easy to deform compressively as compared with the medial side.

Description will then be made of the principle and effect of this aspect.

Upon walking and running, the majority of human beings land on the lateral side of the rear foot portion of the foot. At the time of this landing, the lateral side of the rear foot portion of the foot is subjected to the greatest shock load. It is therefore necessary to relieve the shock load exerted on the lateral side of the rear foot portion of the foot.

In this aspect, the midsole rear foot portion is formed with the concavity that is recessed upward from the bottom face and of which rootbottom portion is offset toward the foot lateral side. For this reason, the lateral side of the midsole rear foot portion can have a reduced pressure-receive area as compared with the medial side of the midsole rear foot portion, so as to be easily compressively deformed. As a result of this, the lateral side of the midsole rear foot portion can compressively deform upon the landing to a large extent, contributing to enhanced shock absorbing properties at the time of the landing.

After the landing, on the contrary, the majority of human beings have a pronating action wherein the foot is slightly inclined toward the medial side.

In the present invention, the rootbottom portion of the concavity is arranged at a site closer to the lateral side of the foot. This allows the medial side of the midsole rear foot portion to have a larger pressure-receive area and thus to present a higher resistance to the compressive deformation than the lateral side of the midsole rear foot portion. As a result of this, the medial side of the midsole rear foot portion is incapable of large compressive deformation after the landing, thus suppressing the pronating action and eliminating any possibilities of occurrence of overpronation.

In the present invention, the sectional geometry of the concavity formed in the midsole is structured to achieve improved shock absorbing property and a suppressed pronating action, thereby preventing the geometry of the midsole from becoming complicated.

In a preferred embodiment of the present invention, the rear foot portion of the outer sole is formed substantially into a shape of horseshoe.

Such a horseshoe-shaped outer sole adds to stability upon the landing.

In another preferred embodiment of the present invention, the midsole is made of a foam resin and the medial side of the rear foot portion and the medial side of the arch portion of the midsole are established to have a higher hardness value than that of the lateral side of rear foot portion and the forefoot portion of the midsole.

Such an establishment of the hardness of the midsole helps the lateral side of the midsole rear foot portion to easily compressively deform. On the other hand, the medial side of the midsole rear foot portion and the medial side of the arch portion become less liable to compressively deform. The shock absorbing effect and the pronation suppressing effect can thus be enhanced.

According to a fourth aspect of the present invention, the shoe sole comprises an outer sole, a midsole and a reinforcement device made of resin plate. The outer sole has a tread face and is divided into a forefoot portion and a rear foot portion. The midsole is formed on top of the outer sole over the forefoot portion, an arch portion, and the rear foot portion. The reinforcement device is fixed firmly to the bottom. face of the arch portion of the midsole.

The rear foot portion of the midsole is formed extending from a medial side to a lateral side of a foot. An exposed portion, that is not covered with the outer sole, is arranged almost in the center between the medial and lateral sides of the foot in the rear foot portion of the midsole.

The exposed portion has a hollow concavity formed upwardly from the tread face (bottom face). The concavity has a rootbottom portion of which depth is the largest in cross section of the midsole.

The rootbottom portion of the concavity is elongated along substantially the longitudinal direction of the shoe sole. The rootbottom portion of the concavity is arranged at a portion closer to the lateral side of the foot, wherein The concavity becomes gradually deeper as it is closer from the medial side of the foot to the rootbottom portion. By shaping the concavity in this manner, the midsole rear foot portion can easily compressively deform in the lateral side than in the medial side.

The reinforcement device is formed in an arch form at the medial side and the lateral side of the foot between the divided portions of the outer sole. In this aspect, flexural rigidity in the medial side portion of the foot of the reinforcement device is established to be higher than that in the lateral side portion of the foot of the reinforcement device.

BRIEF DESCRIPTION OF THE DRAWINGS

The above and other objects, aspects, features and advantages of the present invention will become more apparent from the following description of the preferred embodiments when taken in conjunction with the accompanying drawings. It will however be appreciated that the embodiments and drawings are merely exemplarily given for illustrative purposes only and hence that they are not intended to be used as limiting the scope of the invention. The scope of the invention is therefore to be defined from the appended claims only. In the drawings annexed, the same reference numerals designate identical or corresponding parts throughout several views.

DESCRIPTION OF THE PREFERRED EMBODIMENTS

First Embodiment

FIGS. 1 to 5 illustrate a first embodiment of the present invention.

Figure 3:
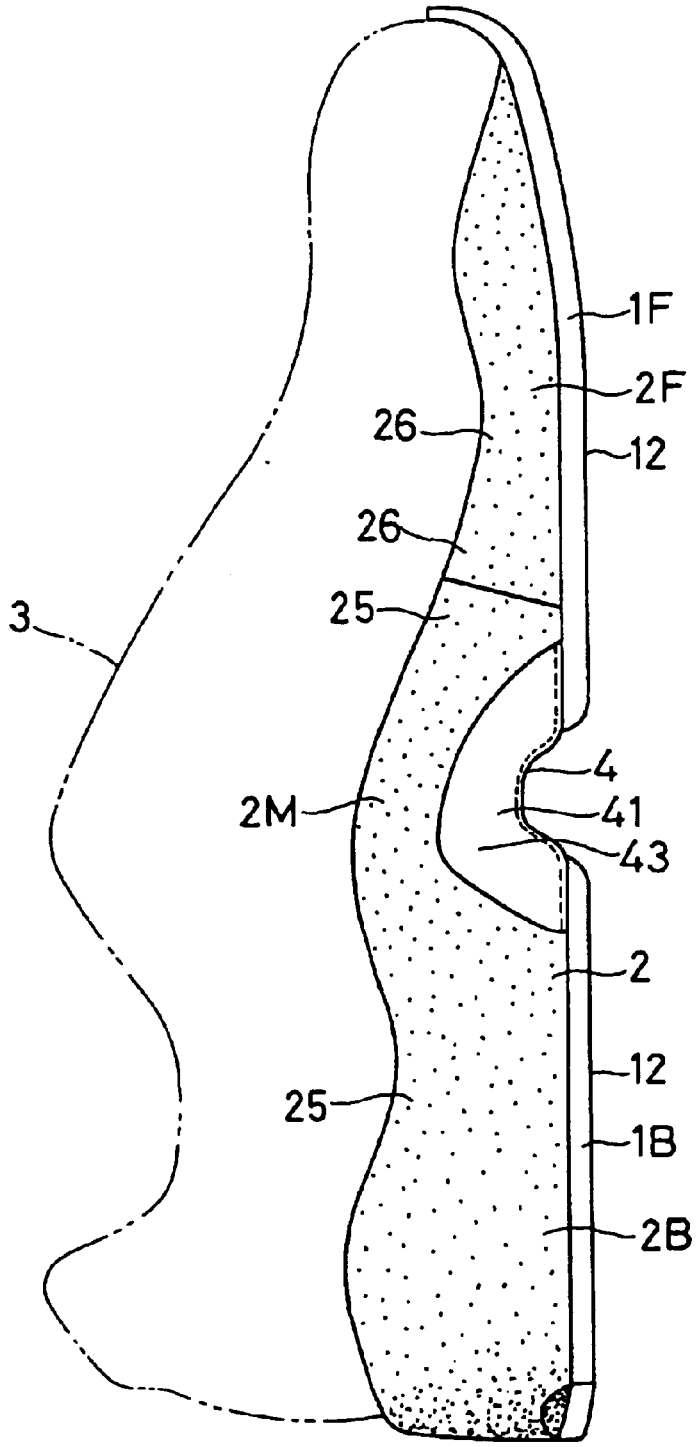
FIG. 3 is a side elevation of a shoe sole viewed from the medial side of the foot.

Referring first to FIG. 3, 1F and 1B denote an outer sole, 2 denotes a midsole, 3 denotes an upper adapted to embrace the instep, and 4 denotes a reinforcement device made of a resin plate. It is to be noted in FIG. 3 that the upper 3 is indicated by a double-dashed line in order to clarify the contour of the upper 3.

The outer sole 1F, 1B consists of a forefoot portion 1F and a rear foot portion 1B. The forefoot portion 1F and the rear foot portion 1B are each provided with a tread face 12. The outer sole 1F, 1B is made of for example rubber and could have an unevenness which is not shown in the figures.

The midsole 2 consists of a forefoot portion 2F, an arch portion 2M and a rear foot portion 2B, which portions are fastened rigidly on the top surface of the outer sole 1F, 1B. The midsole 2 is typically made of resin or a foamed rubber and has shock absorbing properties and resilience.

Figure 1:
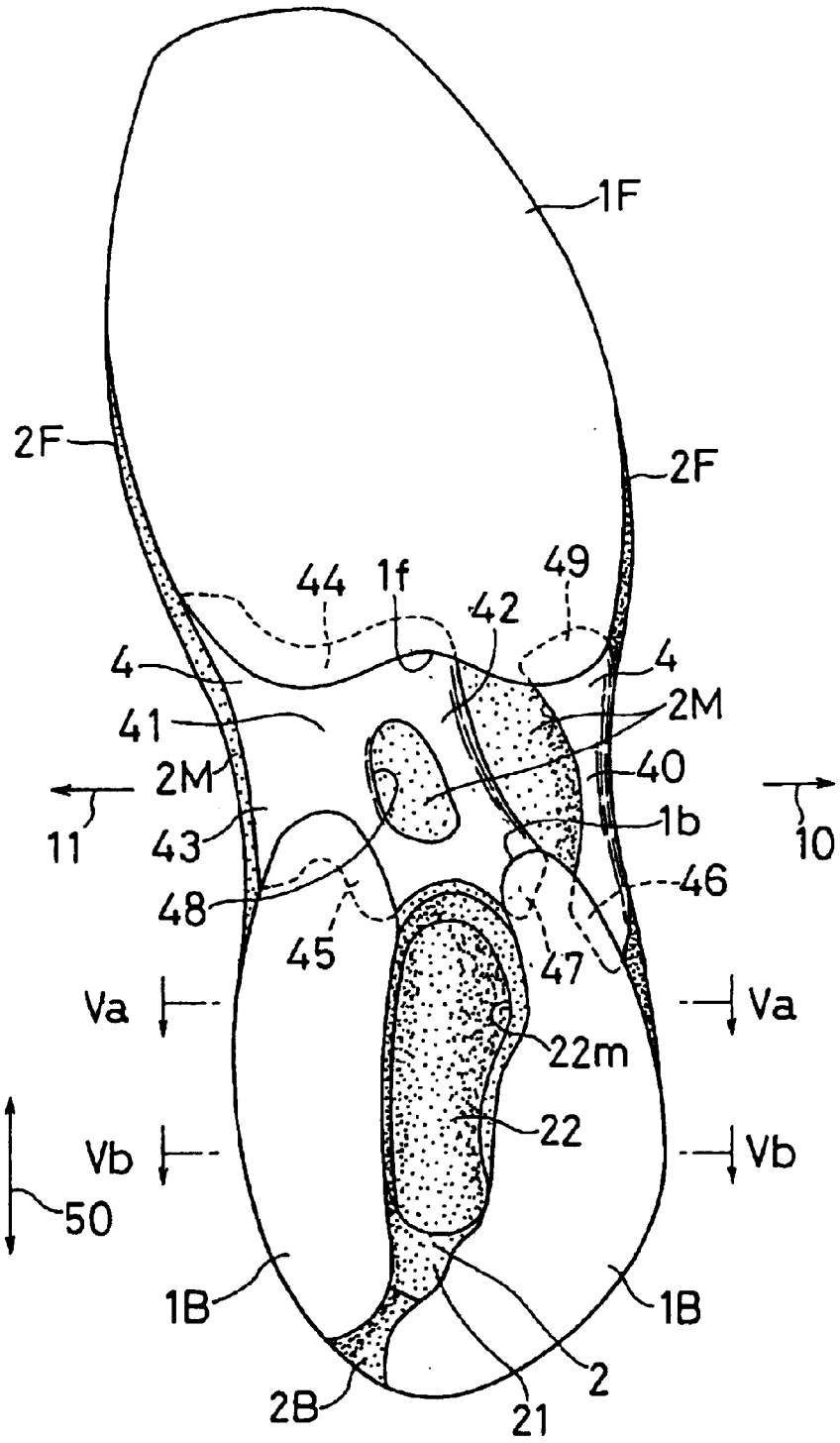
FIG. 1 is a bottom plan view of a shoe sole in accordance with a first embodiment of the present invention.
Figure 2:
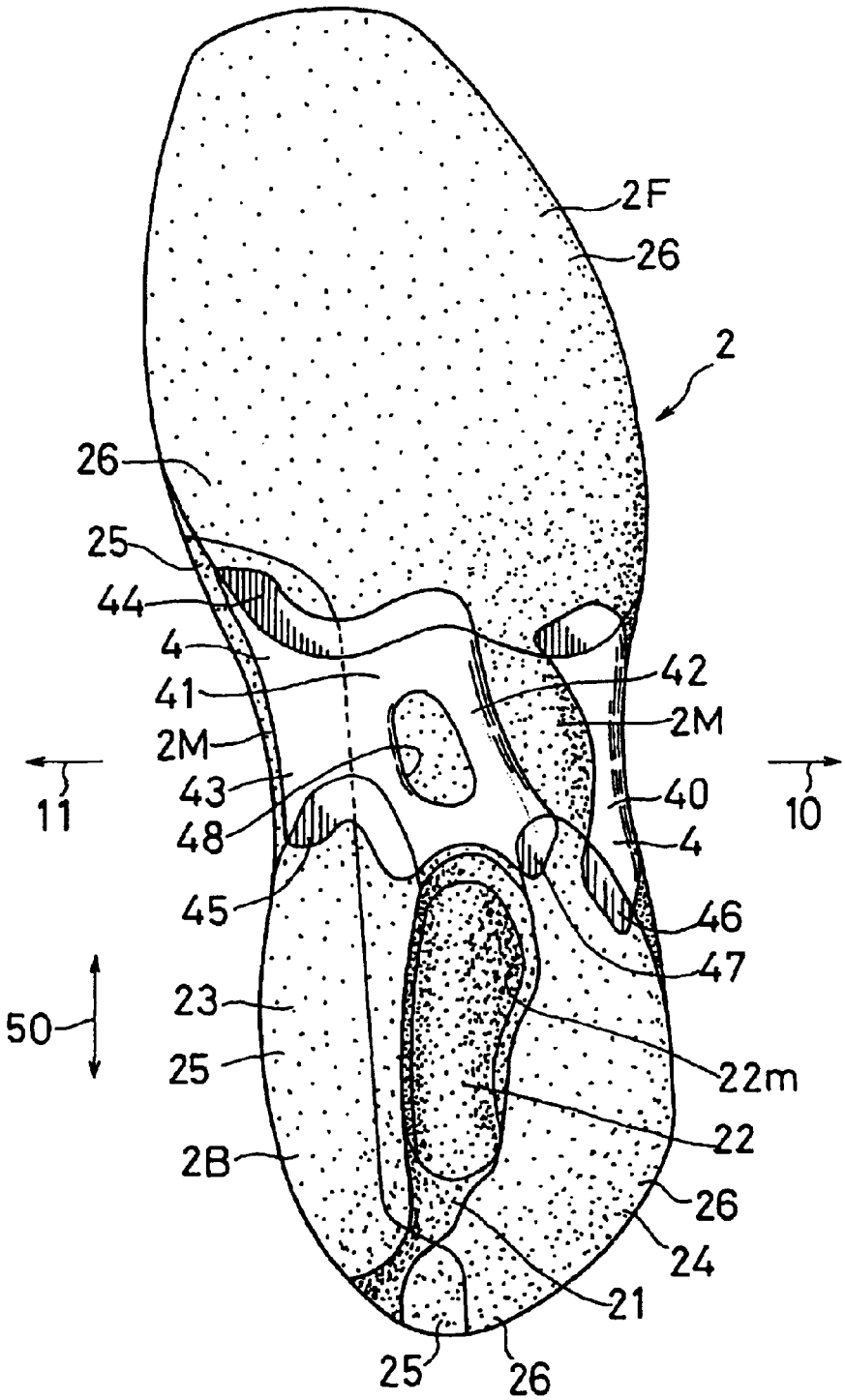
FIG. 2 is a bottom plan view of a midsole and a reinforcement device in accordance with the first embodiment of the present invention.
Figure 4:
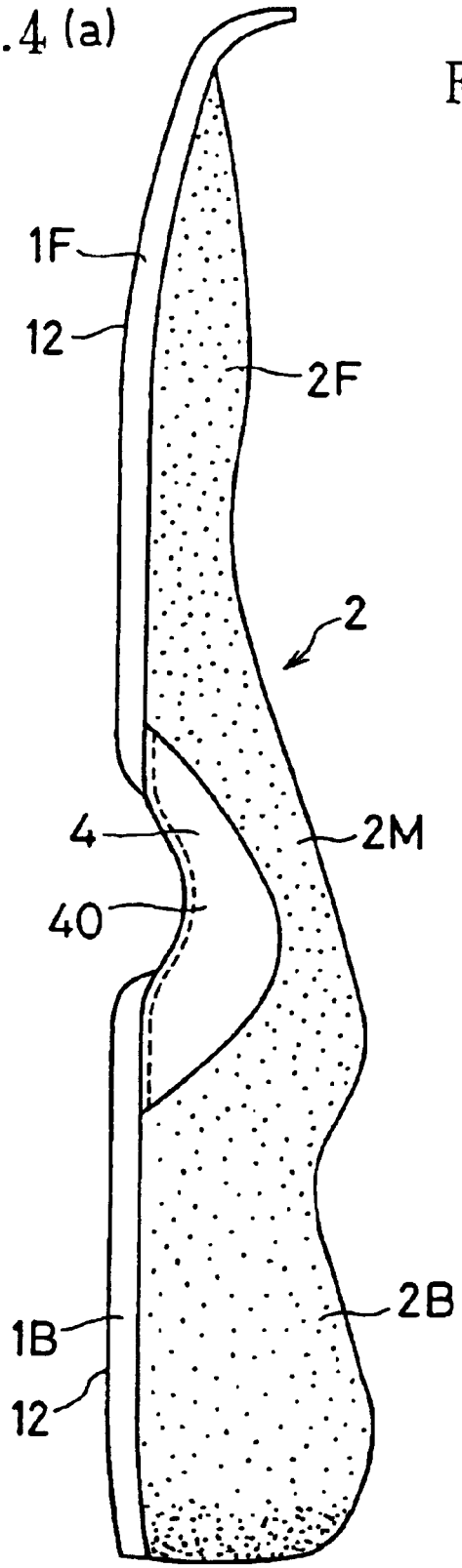
FIG. 4(*a*) is a side elevation of the shoe sole viewed from the lateral side of the foot, and FIG. 4(*b*) is a longitudinal sectional view of a midsole.
Figure 4:
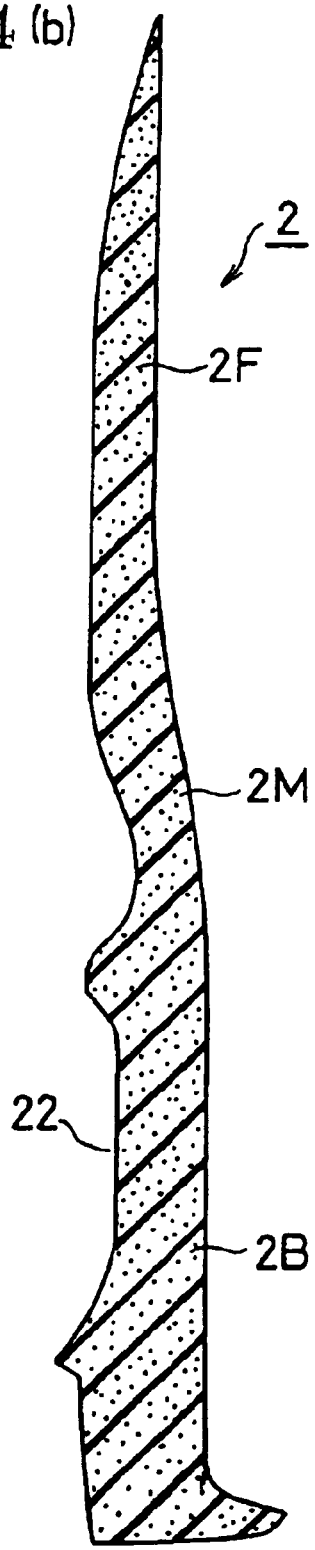

As can be best seen in FIG. 2, the reinforcement device 4 is rigidly fastened on the bottom surface of the arch portion 2M of the midsole 2 and, as shown in FIG. 1, is interposed between the forefoot portion 1F and the rear foot portion 1B of the outer sole. The reinforcement device 4 consists of a medial side reinforcement device 41 and a lateral side reinforcement device 40, which are formed at a medial side 11 and at a lateral side 10, respectively, of the arch as seen in FIGS. 1 and 2, and which are shaped like arches, as shown in FIG. 3 and FIG. 4(*a*), respectively.

As is apparent from FIG. 1, the medial side reinforcement device 41 includes a diagonal reinforcement portion 42 located substantially centrally in the transverse direction of the foot, a medial portion 43 at the innermost site, a fore-end portion 44 and rear end portions 45 and 47, all of which are integrally molded together, with a through-hole 48 positioned in the vicinity of the center. The diagonal reinforcement portion 42 has a tilt to the lateral side 10, toward a fore-end 1*b* of the rear foot portion 1B of the outer sole starting from a rear end 1*f* of the forefoot portion 1F of the outer sole. A fore-end portion 49 of the reinforcement device 40 and the fore-end portion 44 of the reinforcement device 41 are sandwiched between the midsole 2 and the outer sole forefoot portion 1F. On the other hand, a rear end portion 46 of the reinforcement device 40 and the rear end portions 45 and 47 of the reinforcement device 41 are sandwiched between the midsole 2 and the outer sole rear foot portion 1B.

The medial portion 43 of the medial side reinforcement device 41 is designed to have a greater hardness than the lateral side reinforcement device 40. This allows the medial portion 43 of the medial side reinforcement device 41 to have greater flexural rigidity than the lateral side reinforcement device 40. It is preferable that the hardness of the diagonal reinforcement portion 42 be intermediate between the hardness of the medial portion 43 and the hardness of the lateral side reinforcement device 40. It is to be noted, as is clear from the comparison between FIGS. 3 and 4(*a*), that the medial portion 43 of the medial side reinforcement device 41 has a smaller length and a larger curvature of the arch than the lateral side reinforcement device 40 so as to provide an even greater flexural rigidity.

Referring again to FIG. 1, the rear foot portion 1B of the outer sole is formed generally into a shape of horseshoe and consists of a medial foot portion and a lateral foot portion. On the contrary, the midsole 2F, 2M, 2B extends over substantially the whole region from the foot medial side 11 to the lateral side 10. Substantially centrally in the transverse direction of the foot, the midsole rear foot portion 2B is provided with an exposed portion 21 that is not covered with the outer sole 1B.

The exposed portion 21 is formed with a concavity 22 that has concavity that is upward from the tread face 12 substantially at the center of the midsole rear foot portion 2B, as shown in FIGS. 4(*b*) and 5(*a*). The concavity 22 has a rootbottom portion 22*m* of a greatest depth in cross section of the midsole 2. As seen in FIG. 1, the rootbottom portion 22*m* extends generally in the longitudinal direction 50 of the shoe sole.

Figure 5A:
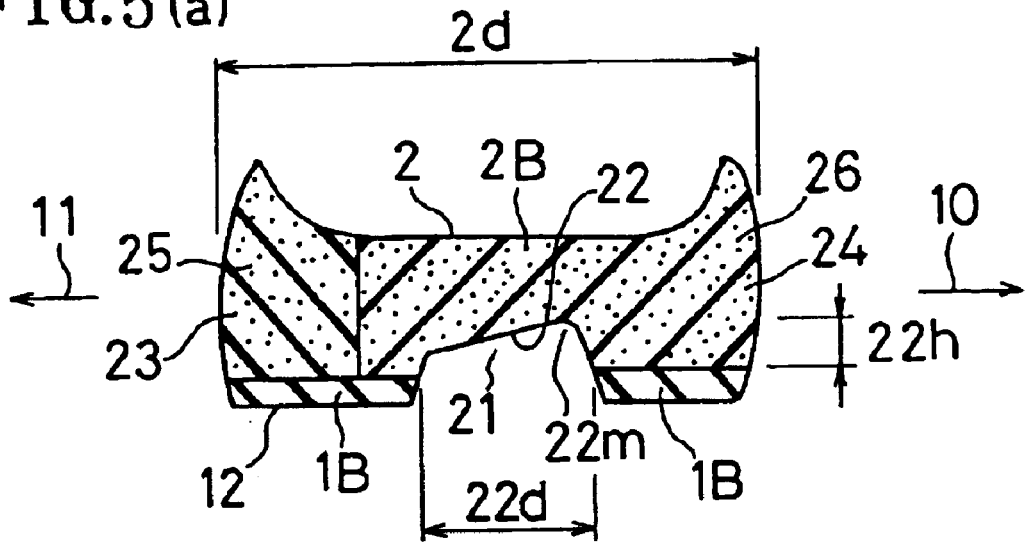
FIG. 5(*a*) is a sectional view taken along a line Va—Va of FIG. 1, and FIG. 5(*b*) is a sectional view taken along a line Vb—Vb of FIG. 1.
Figure 5B:
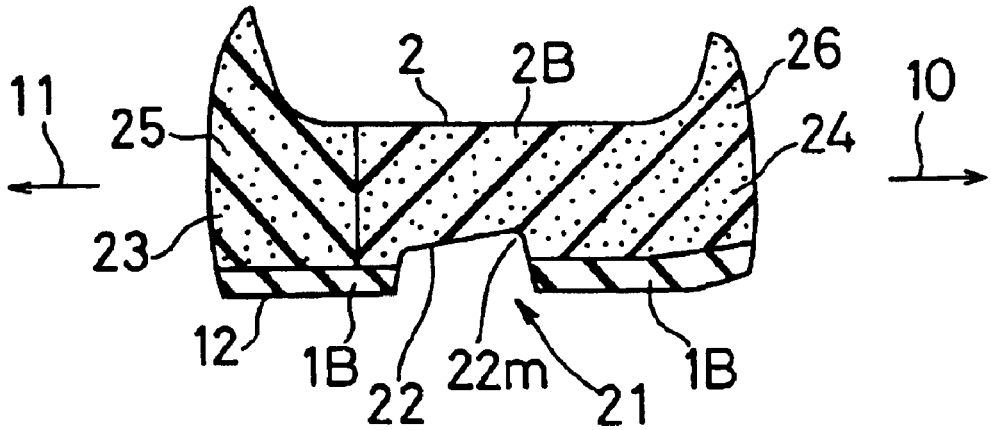

In cross section of FIG. 5(*a*), namely, in cross section of the shoe sole at a site where the concavity 22 has a greatest width in FIG. 1, it is preferred that a width 22*d* of the concavity 22 of FIG. 5(*a*) be about one-fourth to one-half of a width 2*d* of the midsole 2. It is preferred in case of shoes for adults that a depth 22*h* of the rootbottom portion 22*m* be sized typically to be about 5 mm or more.

As can be seen in FIGS. 5(*a*) and 5(*b*), the depth of the concavity 22 is gradually increased from the medial side 11 of the foot toward the rootbottom portion 22*m*, but is sharply reduced from the rootbottom portion 22*m* toward the lateral side 10 of the foot. That is, the rootbottom portion 22*m* of the concavity 22 is offset toward the lateral side 10 rather than the medial side 11 of the foot. This allows the midsole rear foot portion 2B to have a lateral part 24 whose pressure-receive area is smaller than that of a medial part 23, to thereby provide a geometry that is liable to compressively deform upon the landing.

The midsole 2 of this embodiment includes a high-hardness portion 25 and a low-hardness portion 26. As illustrated in FIG. 2, the high-hardness portion 25 occupies the medial side 11 of the midsole rear foot portion 2B and of the midsole arch portion 2M. On the other hand, the low-hardness portion 26 occupies other regions than the high-hardness portion 25, for example the middle and lateral side 10 of the midsole rear foot portion 2B and of the midsole arch portion 2M, as well as the region of the midsole forefoot portion 2F.

Second Embodiment

Figure 6:
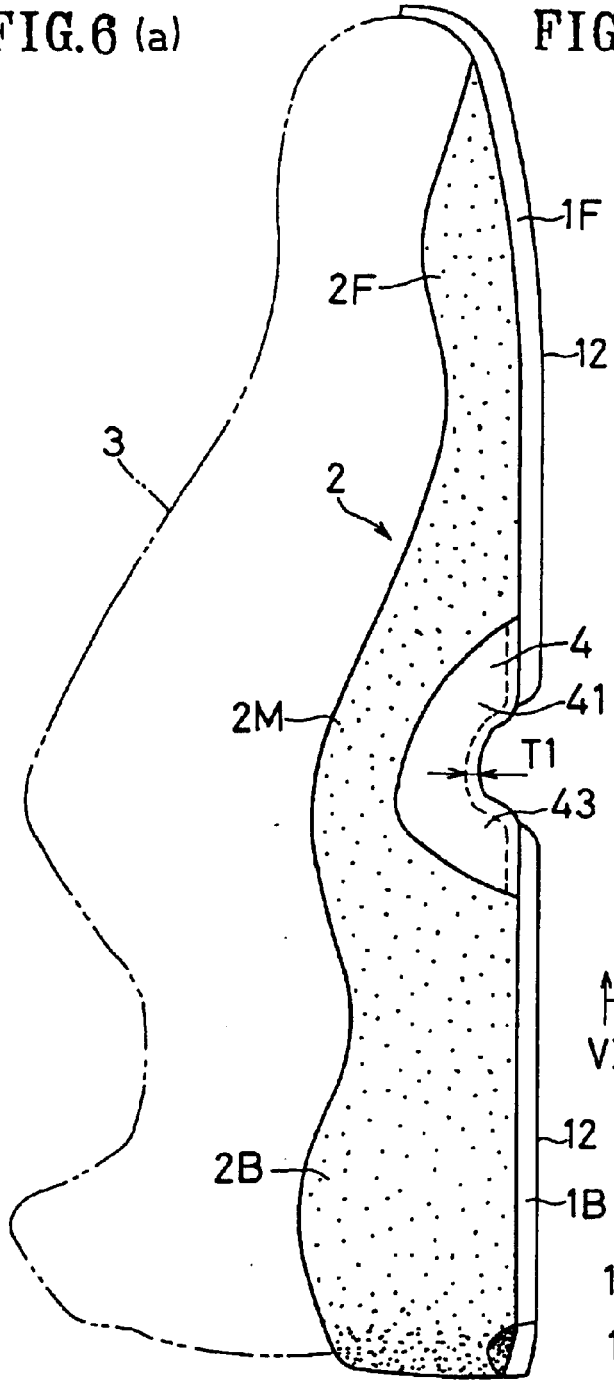
FIGS. 6(*a*) to 6(*c*) illustrate a second embodiment of the present invention, with FIG. 6(*a*) being a side elevation of a shoe sole viewed from the medial side of the foot, with FIG. 6(*b*) being a side elevation of a shoe sole viewed from the lateral side of the foot, and with FIG. 6(*c*) being a transverse cross section of a rear foot portion of the shoe sole.
Figure 6:
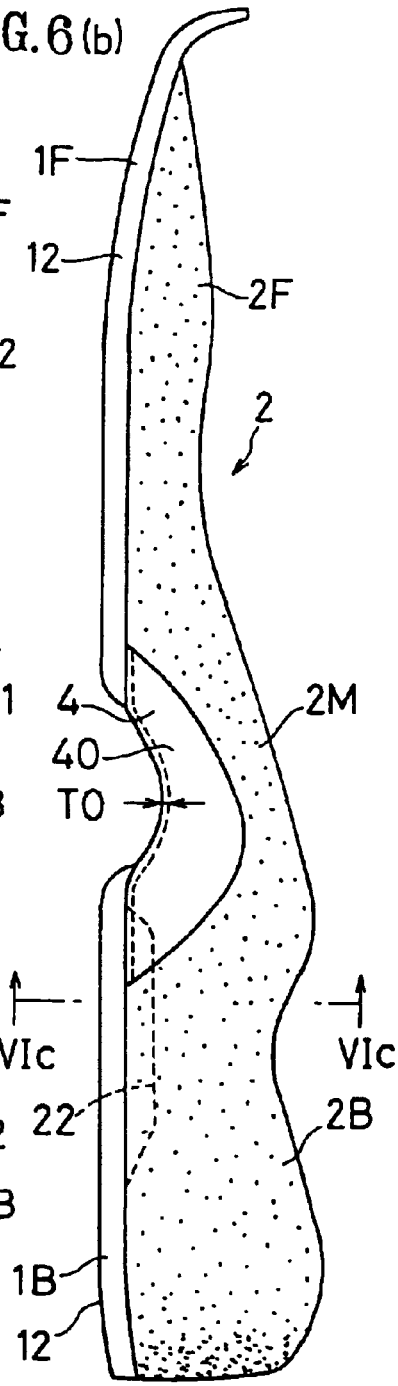
Figure 6C:
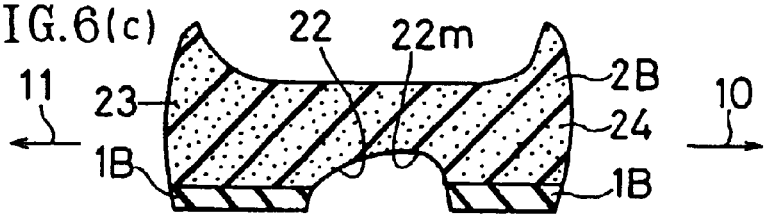

FIGS. 6(*a*) to 6(*c*) illustrate a second embodiment of the present invention.

In the second embodiment, a thickness T1 of the medial side reinforcement device 41 is set to be larger than a thickness T0 of the lateral side reinforcement device 40. This allows the medial portion 43 of the medial side reinforcement device 41 to have a greater flexural rigidity than the lateral side reinforcement device 40. In this case, the hardness of the reinforcement device 4 need not be set as indicated in the first embodiment, although the hardness of the reinforcement device may be set similar to the first embodiment.

Furthermore, as shown in FIG. 6(*c*), the concavity 22 of this embodiment has a smooth contour in cross section. The midsole 2 has a uniform hardness throughout. The other features of the second embodiment are similar to those of the first embodiment, and the identical or corresponding parts are designated as the same reference numerals and are not described and illustrated.

Figure 7A:
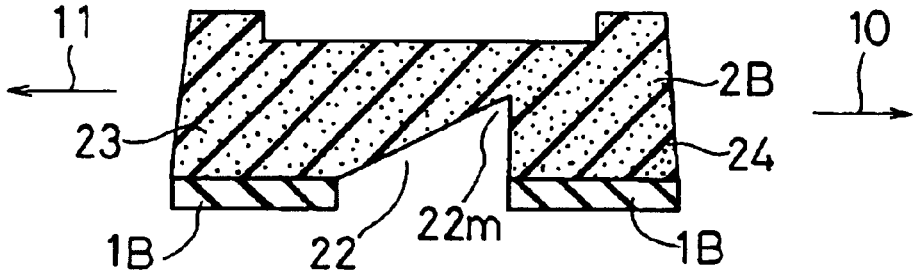
FIG. 7(*a*) is a transverse cross section of a shoe sole showing a first variant of a concavity in accordance with the present invention, FIG. 7(*b*) is a transverse cross section of a shoe sole showing a second variant of the same, and FIG. 7(*c*) is a transverse cross section of a shoe sole showing a third variant of the same.
Figure 7B:
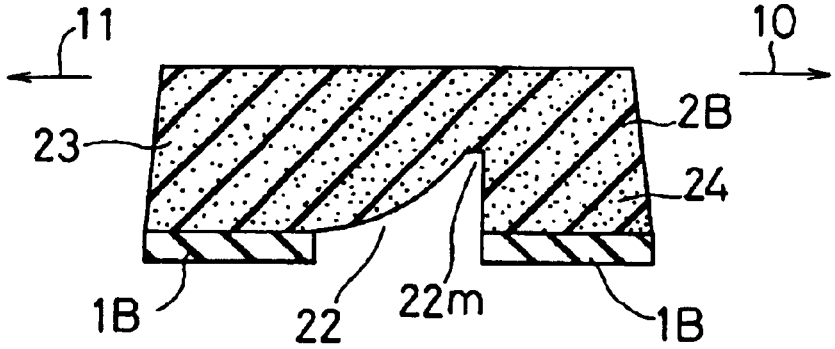
Figure 7C:
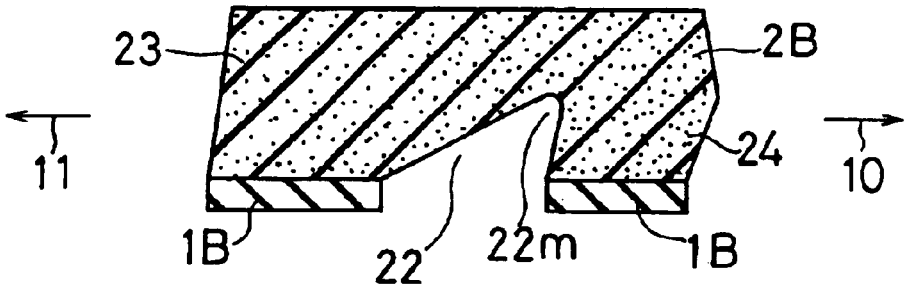
Figure 8:
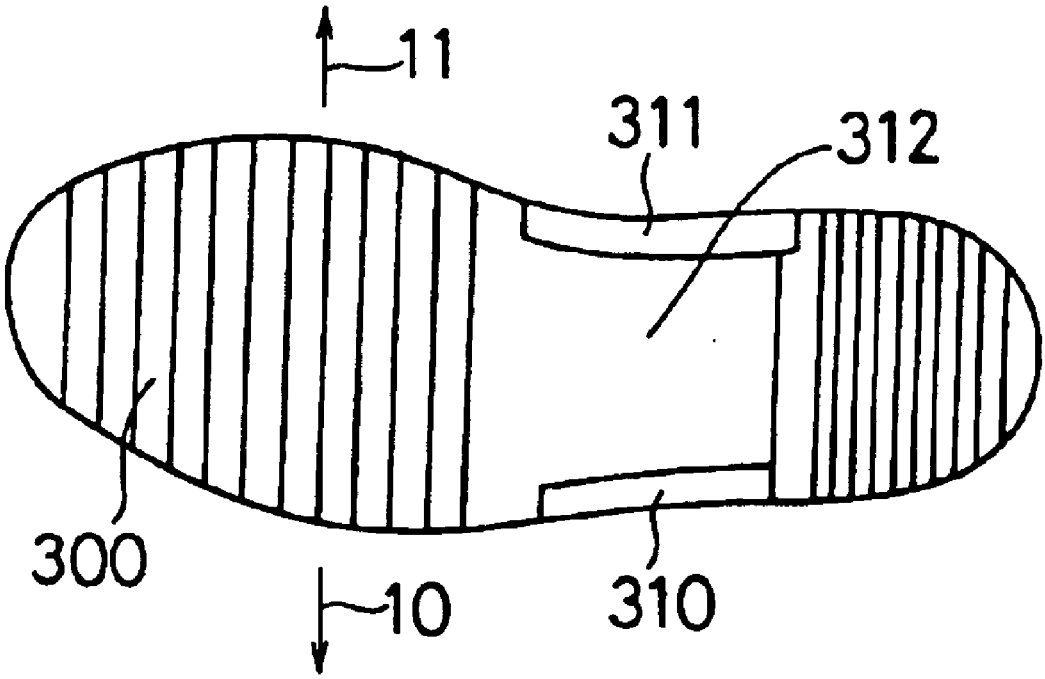
FIG. 8 PRIOR ART
FIG. 8 is a bottom plan view of a shoe sole disclosed in Japan Utility Model Registration Pub. No. 2, 544, 047.
Figure 9:
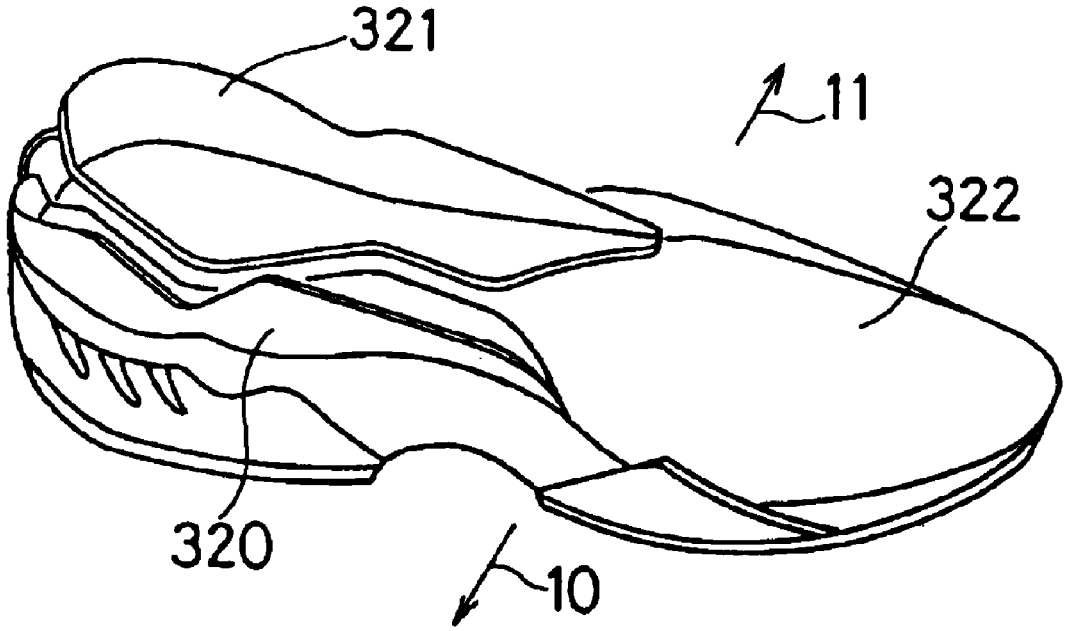
FIG. 9 PRIOR ART
FIG. 9 is a perspective view of a shoe sole disclosed in Japan Patent Laid-open Pub. No. Hei9-47305.
Figure 10:
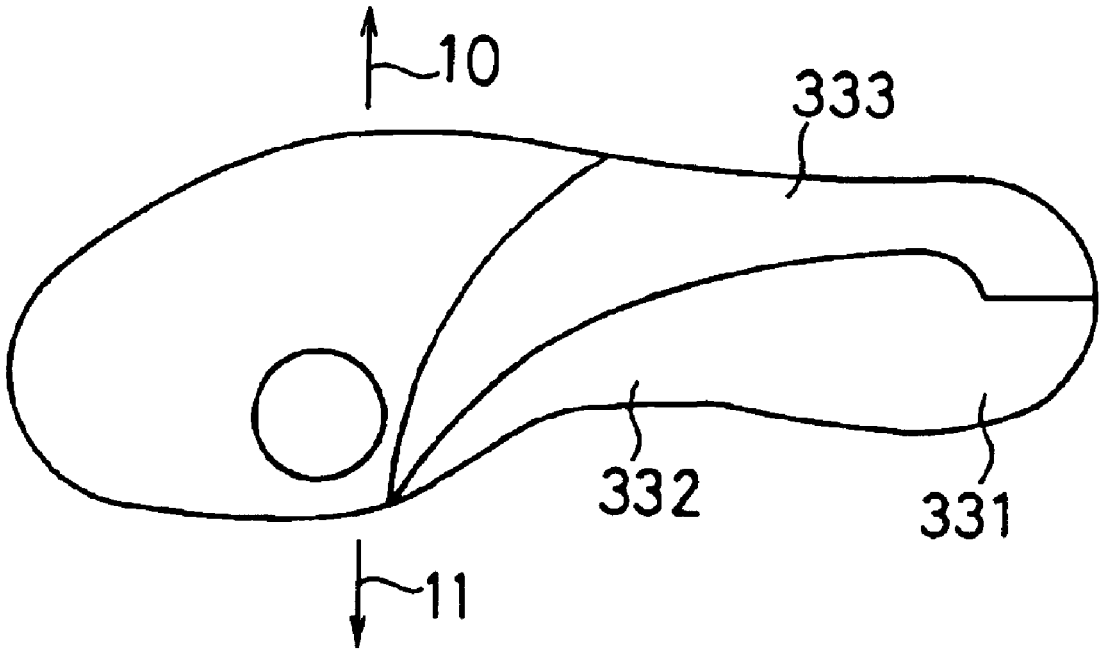
FIG. 10 PRIOR ART
FIG. 10 is a top plan view showing an outer sole disclosed in Japan Patent Laid-open Pub. No. Hei5-329005.
Figure 11A:
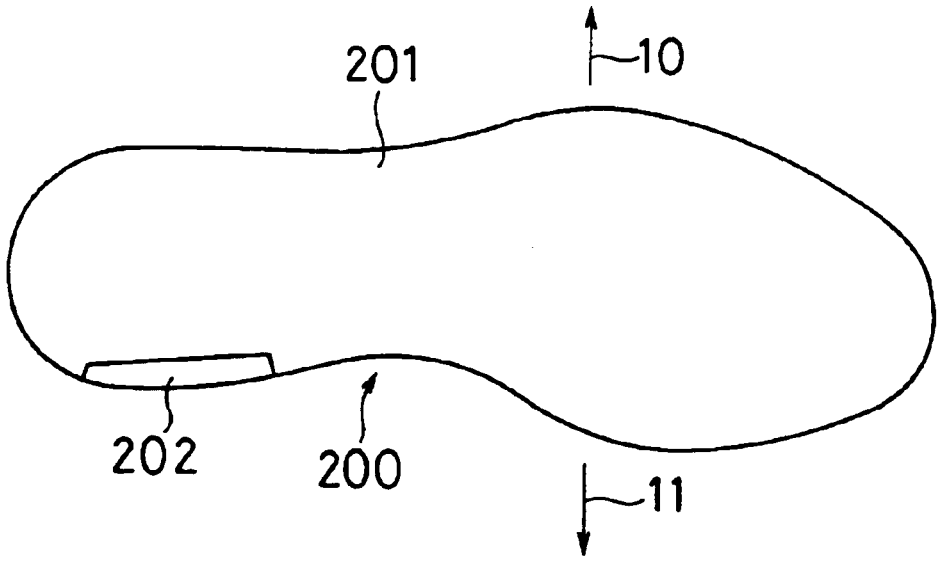
FIG.11(a) PRIOR ART
FIG. 11(*a*) is a top plan view of a midsole disclosed in Japan Patent Pub. No. Sho61-7801, and FIG. 11(*b*) is a side elevational view of the same.
Figure 11B:
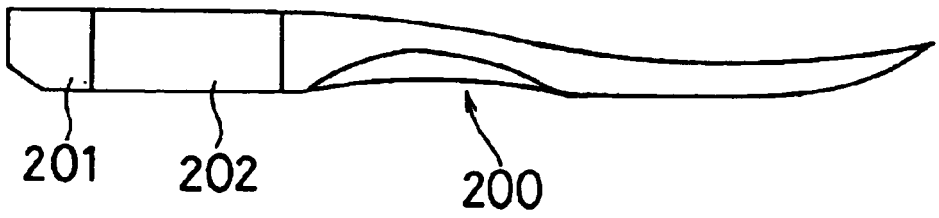
FIG.11(b) PRIOR ART

FIGS. 7(*a*) to 7(*c*) depict variants of the present invention.

In a first variant of FIG. 7(*a*), the rootbottom portion 22*m* is positioned closest to the lateral side 10 in the concavity 22 in such a manner that the rootbottom portion 22*m* lies on an imaginary line extending upwardly at right angles from the lateral side edge of the concavity 22.

In a second variant of FIG. 7(*b*), the concavity 22 is defined by a downwardly convex line, with the rootbottom portion 22*m* lying on the imaginary line extending upwardly at right angles from the lateral side edge of the concavity 22.

In a third variant of FIG. 7(*c*), the rootbottom portion 22*m* is offset toward the lateral side 10 relative to the imaginary line extending upwardly at right angles from the lateral side edge of the concavity 22.

The results of computer simulations on the present invention are shown below to make clear the effect of the invention.

First, as shown in FIGS. 12(*a*) to 12(*e*) and TABLE 1, fifteen models were assumed that had respective rootbottom portions 22*m* different in location and in depth 22*h*. A thickness Th, an overall width W, W1, and a width W2 of the concavity 22 were 25 mm, 80 mm, 25 mm and 30 mm, respectively.

TABLE 1

Figure 12A:
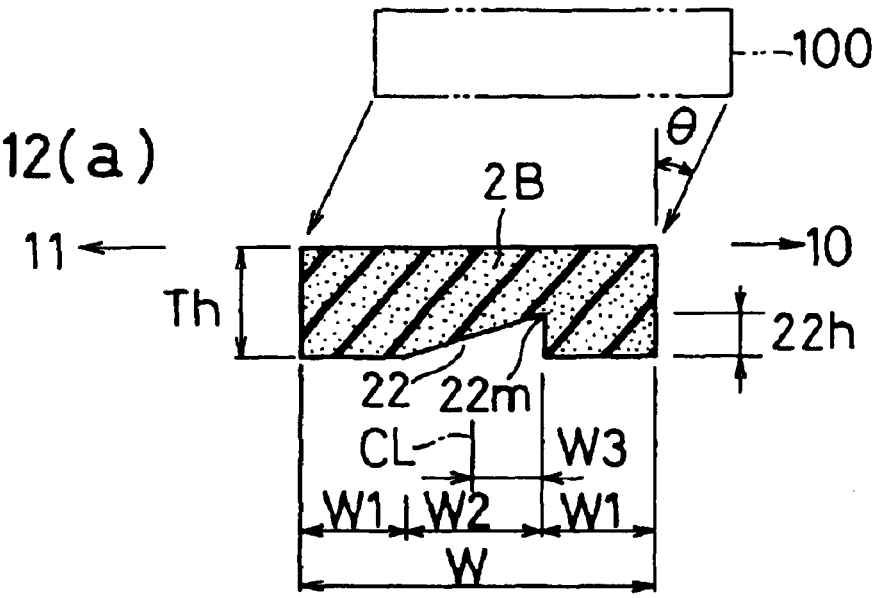
FIGS. 12(*a*) to (*e*) are sectional views of a resin sponge for use in simulations.
Figure 12B:
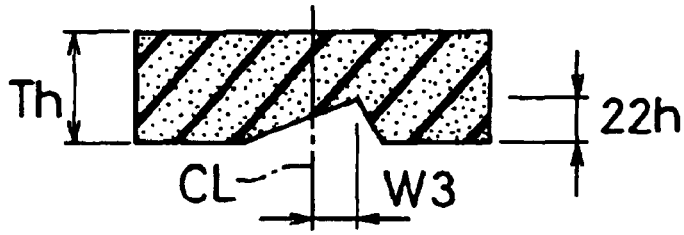
Figure 12C:
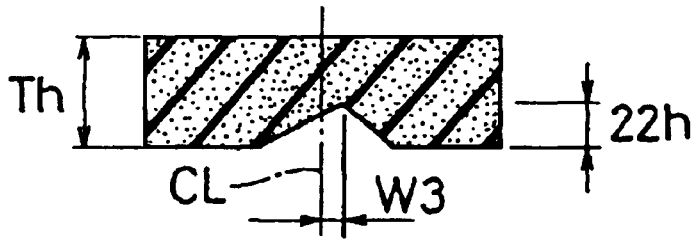
Figure 12D:
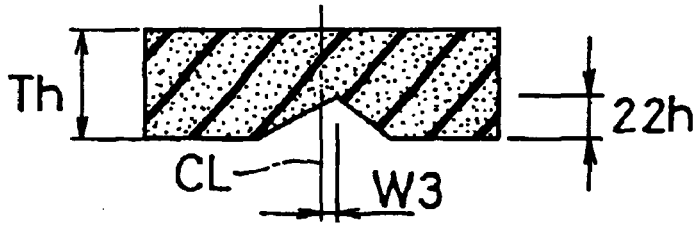
Figure 12E:
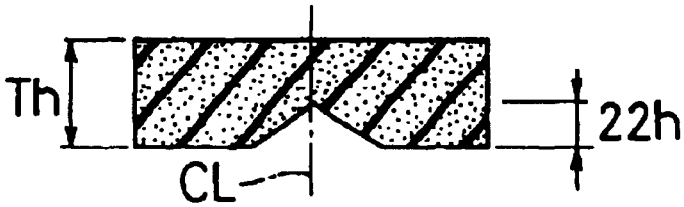

| | | Depth (22 h) | | |
|---|---|---|---|---|
| | W3 | 8 mm | 10 mm | 12 mm |
| TYPE 1 (FIG. 12(a)) | 15 mm | 0.011688 | 0.012138 | 0.013131 |
| TYPE 2 (FIG. 12(b)) | 10 mm | 0.011655 | 0.012228 | 0.012642 |
| TYPE 3 (FIG. 12(c)) | 6 mm | 0.011532 | 0.011864 | 0.012258 |
| TYPE 4 (FIG. 12(d)) | 5 mm | 0.011301 | 0.011787 | 0.012132 |
| TYPE 5 (FIG. 12(e)) | 0 mm | 0.011526 | 0.011847 | 0.012192 |

The simulations were used to figure out the shock absorbing properties of the lateral side 10 against shocks to which the fifteen models were subjected when a weight 100 indicated by a chain double-dashed line was caused to collide therewith from diagonally above. The results are shown in TABLE 1. The shock absorbing properties are obtained by decomposing, for each frequency, the shocks which the weight 100 corresponding to the foot undergoes upon the collision of the weight 100 with the model and quantifying the damping of low-frequency components for which the human body may feel uncomfortable. It has been verified from the comparison with the sensory test that in TABLE 1, larger values represent better shock absorbing properties.

From these simulations it has been determined that more remarkable shock absorbing effects are obtained as the depth of the rootbottom portion 22*m* increases and the rootbottom portion 22*m* is offset 10 mm or more toward the lateral side 10 relative to a center line CL of the concavity 22. In the present invention, therefore, the rootbottom portion 22*m* is preferably offset 6 mm (20% of the width W2 of the concavity 22) or more toward the lateral side 10 relative to the center line CL of the concavity 22, and more preferably it is offset 8 mm (26.7% of the width W2 of the concavity 22) toward the lateral side 10 relative to the center line CL of the concavity 22.

By the way, data on a type 4 model show lowered shock absorbing properties as compared with a symmetrical type 5 model. This may result from an angle θ of collision of the weight 100 against the model and, if the angle θ=0, the type 4 model could have better shock absorbing properties than the type 5 model. Therefore, the rootbottom portion 22*m* having an approx. 5 mm (16.7% of the width W2 of the concavity 22) offset toward the lateral side 10 relative to the center line CL of the concavity 22 is also to be construed as lying within the scope of the present invention.

Although the preferred embodiments have hereinabove been described with reference to the accompanying drawings, it will be apparent to those skilled in the art that various changes and modifications are conceivable from this specification without departing from the obvious scope of the invention.

For example, the top surface of the midsole may be provided with a concavity that is filled with a cushioning material such as rubber having a low hardness or resin foam or gel.

In the present invention, the midsole may have a uniform hardness throughout.

Although the above embodiments have employed the reinforcement device 4 separated into the lateral side reinforcement device 40 and the medial side reinforcement device 41, the reinforcement device 4 of the present invention may be integrally formed without separation into lateral and medial parts. It is preferred in such a case that the rear end portion 47 of the diagonal reinforcement portion 42 of FIG. 1 be joined to the rear end portion 46 of the lateral side reinforcement device 40.

In the present invention, the diagonal reinforcement portion 42 need not necessarily be provided.

The outer sole 1F, 1B may be provided with a raised portion made of resin non-foam in addition to the rubber foam or non-foam.

Thus, such variations and modifications are intended to be construed as lying within the scope of the invention defined by the appended claims.

What is claimed is:

1. A shoe sole comprising:

an outer sole having a tread face and divided by an arch portion into a forefoot portion and a rear foot portion which are spaced from each other;

a midsole formed on top of the outer sole over the forefoot portion, the arch portion, and the rear foot portion; and a reinforcement device, made of a resin plate, fixed firmly to a first bottom face of the arch portion of the midsole, wherein the reinforcement device has a second bottom face, which is apart from a ground between the forefoot portion and the rear foot portion of the outer sole, whereby the second bottom face, together with the ground, forms a hollow, extending through from a medial side of a foot to a lateral side of the foot between the forefoot portion and the rear foot portion of the outer sole, and wherein thickness in a medial side portion of the foot of the reinforcement device is established to be greater than that in a lateral side portion of the foot of the reinforcement device so that flexural rigidity in the medial side portion of the foot of the reinforcement device is higher than that in the lateral side portion of the foot of the reinforcement.

2. The shoe sole according to claim 1, wherein the reinforcement device consists of resilient laminate layer.

3. The shoe sole according to claim 1, wherein a part of the reinforcement device is just in the arch portion.

4. The shoe sole according to claim 1, wherein the reinforcement device is substantially coextensive with and substantially limited to the arch portion.

5. The shoe sole according to claim 1, wherein the reinforcement device is divided into two parts, one in a medial direction, and the other in a lateral direction of the foot.

6. The shoe sole according to claim 1, where n the reinforcement device has a diagonal reinforcement portion arranged almost in the center between the medial and lateral sides of the foot and extending in a diagonal direction from the medial side of the rear end of the forefoot portion of the outer sole to the lateral side of the front end of the rear foot portion of the outer sole.

7. The shoe sole according to claim 1, wherein the midsole is made of foam resin extending from the forefoot portion to the rear foot portion, and wherein the medial side of the arch portion of the midsole has a higher hardness value than that of the lateral side of the rear foot portion and the forefoot portion of the midsole.

8. A shoe sole comprising:

an outer sole having a tread face and divided by an arch portion into a forefoot portion and a rear foot portion which are spaced from each other;

a midsole formed on top of the outer sole over the forefoot portion, the arch portion, and the rear foot portion; and a reinforcement device made of a resin plate having a first face and a second face, the first face of the reinforcement device fixed firmly to a bottom face of the arch portion of the midsole, wherein the second face of the reinforcement device between the forefoot portion and the rear foot portion of the outer sole is formed in an arch at a lateral and medial sides of a foot and spaced from the ground, whereby the second face, together with the ground, forms a hollow, extending through from the medial side of the foot to the lateral side of the foot between the forefoot portion and the rear foot portion of the outer sole, and wherein thickness in a medial side portion of the foot of the reinforcement device is established to be greater than that in a lateral side portion of the foot of the reinforcement device so that flexural rigidity in the medial side portion of the foot of the reinforcement device is higher than that in the lateral side portion of the foot of the reinforcement.

* * * * *